US010954610B2

(12) United States Patent
Nägeli

(10) Patent No.: US 10,954,610 B2
(45) Date of Patent: Mar. 23, 2021

(54) DOFFER DEVICE HAVING A DOUBLE GRIPPER FOR A SPINNING MACHINE

(71) Applicant: Maschinenfabrik Rieter AG, Winterthur (CH)

(72) Inventor: Robert Nägeli, Kleinandelfingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 123 days.

(21) Appl. No.: 15/777,005

(22) PCT Filed: Nov. 8, 2016

(86) PCT No.: PCT/IB2016/056705

§ 371 (c)(1),
(2) Date: May 17, 2018

(87) PCT Pub. No.: WO2017/085588

PCT Pub. Date: May 26, 2017

(65) Prior Publication Data

US 2018/0327936 A1 Nov. 15, 2018

(30) Foreign Application Priority Data

Nov. 19, 2015 (CH) ..... 01687/15

(51) Int. Cl.
*D01H 9/08* (2006.01)
*D01H 9/04* (2006.01)
*D01H 9/00* (2006.01)

(52) U.S. Cl.
CPC ..... *D01H 9/08* (2013.01); *D01H 9/003* (2013.01); *D01H 9/04* (2013.01)

(58) Field of Classification Search
CPC ..... B65H 67/0405; D01H 9/02; D01H 9/04; D01H 9/043; D01H 9/046
See application file for complete search history.

(56) References Cited

U.S. PATENT DOCUMENTS 1,496,079 A 6/1924 Alderman
1,670,580 A 5/1928 Kerwin
(Continued)

FOREIGN PATENT DOCUMENTS

CH 698 344 A1 7/2009
DE 11 75 587 B 8/1964
(Continued)

OTHER PUBLICATIONS

Swiss Patent Office Search Report, dated Feb. 1, 2016.
PCT Search Report, dated Feb. 7, 2017.

*Primary Examiner* — William E Dondero
(74) *Attorney, Agent, or Firm* — Dority & Manning, P.A.

(57) ABSTRACT

A doffer device for a spinning machine includes a plurality of gripping devices, each gripping device having a rotatable gripping unit. Each gripping unit includes a bobbin gripper that grips a full bobbin and a tube gripper that grips an empty tube. Each gripping unit is rotatable between a gripping position in which the full bobbin can be gripped on the spindle and a placement position in which the empty tube can be placed on the spindle. A rotating device is configured with the gripping units to rotate the gripping units about an axis of rotation such that neighboring ones of the gripping units are rotated with a time lag relative to one another. The rotating device is driven by a toothed belt.

12 Claims, 5 Drawing Sheets

(56) References Cited

U.S. PATENT DOCUMENTS

| | | | | |
|---|---|---|---|---|
| 4,658,575 | A | 4/1987 | Houget | |
| 4,682,466 | A * | 7/1987 | Meroni ..... | D01H 9/04 57/266 |
| 4,938,017 | A | 7/1990 | Städele | |
| 5,168,697 | A | 12/1992 | Brockmanns et al. | |

FOREIGN PATENT DOCUMENTS

| | | | |
|---|---|---|---|
| DE | 33 34 790 | A1 | 4/1985 |
| DE | 36 40 002 | A1 | 5/1988 |
| DE | 39 27 829 | A | 2/1991 |
| EP | 0 201 942 | A1 | 11/1986 |
| FR | 589966 | | 6/1925 |
| FR | 1 301 145 | A | 8/1962 |
| GB | 6 631 119 | | 12/1951 |

* cited by examiner

DOFFER DEVICE HAVING A DOUBLE GRIPPER FOR A SPINNING MACHINE

TECHNICAL FIELD

The present invention relates to a doffer device for a spinning machine having a plurality of spinning stations. The invention also relates to a method for removing full bobbins from spindles of a spinning machine and placing empty tubes on the spindles using a doffer device, and a gripping device for a doffer device.

BACKGROUND

Doffer devices for spinning machines are well known. The doffer device usually has a plurality of gripping devices, so that a gripping device is assigned to each spinning station. In many cases, such a gripping device has a gripper, which first removes a full bobbin from a spindle and places it on a peg on a conveyor belt, for example. Then the gripper grips an empty tube, removing it from a peg on a conveyor belt, for example, and places it on the spindle. Between removal of the bobbin and placement of the tube, a bar on the doffer device, on which the gripping devices are arranged, must be moved from the spinning station to the conveyor belt and then back to the spinning station. Because of the size of the doffer device, this movement is usually time consuming, which results in a loss of spinning time.

DE3640002A1 describes a doffer device having gripping devices to solve this problem, each of the gripping devices being provided with two controllable gripping elements for gripping tubes and bobbins. The gripping elements are accommodated in a rotating disk driven by means of an adjusting drive. For a doffing operation, the first gripping element first grips an empty tube. Then the bar on the doffer device moves the gripping devices together with the empty tubes to the spinning stations. The second gripping element then removes the full bobbin from the spindle at the spinning station. Then the adjusting drive rotates the rotating disk, so that the first gripping element with the empty tube is placed on the spindle. Then the first gripping element places the empty tube on the spindle. Once this is done, the spinning process can be continued. With this doffer device, great distances of travel of the bar during the shutdown of the spinning stations are avoided and this saves time. However, one disadvantage of this doffer device is that the gripping devices with the rotating disks need more space in the direction of the longitudinal axis of the spinning machine than is available between two spinning stations on many contemporary spinning machines.

FR589966 discloses a doffer double gripper, which receives the finished cop at the side and positions it with empty tubes. However, one disadvantage of this embodiment is the lower fastening of the tubes/cops because this is a stability problem.

SUMMARY OF THE INVENTION

An object of the present invention is thus to create a doffer device, a method, and the respective gripping devices which will allow a rapid doffing operation with a limited amount of available space.

An object of the present invention is also to create a method and the respective gripping devices which will facilitate easy operation for the operator in the event of a malfunction.

An object of the present invention is also to create a doffer device, a method and the respective gripping devices which will permit secure holding of the tube and bobbin.

Additional objects and advantages of the invention will be set forth in part in the following description, or may be obvious from the description, or may be learned through practice of the invention.

The objects are achieved by a doffer device and a method for removing full bobbins from spindles of a spinning machine and for positioning empty tubes on the spindles using a doffer device and gripping devices for a doffer device having the features described and claimed herein.

A doffer device for a spinning machine having a plurality of spinning stations is proposed for removing full bobbins from spindles on the spinning machine and for placement of empty tubes on the spindles. The doffer device has at least one bar and a plurality of gripping devices, so that a gripping device is assigned to each spinning station. The gripping devices are attached to the at least one bar. Furthermore, the at least one bar is movable, so that it can bring the gripping devices into the positions relevant for the doffing operation, for example, to a conveyor belt to receive the empty tubes and to place the full bobbins, and to the spindles, to remove the full bobbins and to place the empty tubes in position.

The gripping devices each have a base body and a rotary gripping unit. The gripping unit comprises a bobbin gripper and a tube gripper. The bobbin gripper is designed for gripping the full bobbin and the tube gripper is designed for gripping the empty tube.

Finally, the doffer device has a direction of rotation for rotation of the gripping units. The gripping units can therefore be rotated between a gripping position, in which the bobbin can be gripped on the spindle, and a placement position, in which the tube can be placed on the spindle.

According to the invention, the rotating device comprises rotating means and a drive means. One of the rotating means is assigned to each gripping device, and the drive means is assigned to a plurality of gripping devices. In addition, the rotating device is designed so that it can cause two neighboring gripping units to rotate with a time lag relative to one another. In other words, if neighboring gripping elements are not rotated at the same time, then the rotation of one gripping element does not interfere with the rotation of the other gripping element. This permits a design of the doffer device, which allows a rapid doffing operation even when there is a limited amount of available space. According to the invention, the doffer device can be driven with a toothed belt.

In an advantageous refinement of the invention, each gripping unit has two indicators with which the position of the rotational device can be seen through a base body. If a malfunction has occurred and the operator must re-engage or equip a gripping unit, then he can in this way recognize the correct position from the outside. The two indicators must be set with alternating settings in the case of neighboring gripping units, so that the gripping units can be placed in position, and the missing gripping unit can be used correctly.

The bobbin gripper advantageously has a bobbin receptacle that is open at the bottom, and the tube gripper advantageously has a tube receptacle that is open at the bottom and can be inverted over the bobbin and/or the tube for gripping them from above. The tube gripper and the bobbin gripper may be designed to be cylindrical or conical. The conical embodiment has the advantage of a better hold of the tube and the bobbin, in particular when the two are operated pneumatically because the membrane is better adapted to the tube and bobbin.

In an advantageous refinement of the invention, the gripping devices have positioning means. The purpose of these positioning means is to accurately position the gripping units in the gripping position and/or in the placement position with respect to the spindle. The required precision in positioning depends on the design of the bobbin gripper and/or tube gripper. For example, if they have a funnel-shaped area, which leads the bobbin and/or tube in the direction of a bobbin receptacle or a tube receptacle, respectively, then a minor deviation from the perfect position can be tolerated. The positioning in the gripping position and/or placement position should thus be accurate enough so that the gripping of the bobbin and/or the placement of the tube will always function with no problem, which depends on the details of the spinning machine and the doffer device. With a well-positioned gripping unit, the removal of a full bobbin and placement of an empty tube, respectively, can then be carried out accurately, which facilitates a frictionless doffing operation.

The drive means advantageously comprise a motor and a drive belt. It is conceivable that each gripping device is assigned a motor and that these motors are controlled in such a way that they cause two neighboring gripping units to rotate with a time lag relative to one another. However, one motor may drive the drive belt, so that the rotations of the gripping units are centrally controlled for the drive belt, which is the less expensive alternative for the case of a plurality of gripping devices in particular.

It is also advantageous if the rotational means comprise gear wheels and the drive means have at least one toothed area. The gear wheels are connected to the gripping devices, and the toothed area of the drive means engages with the gear wheels. Due to the form-fitting connection, reliable operation of the gripping units is ensured and a linear movement of the toothed region is converted into a rotational movement of the gear wheels.

Furthermore, it is advantageous if the rotational means and/or the drive means have a rated capacity limiter. Thus, for the case when one gripping device is blocked, severe damage to the gripping device or the drive means can be prevented. Furthermore, with a rated capacity limiter, it is possible to continue the doffing operation for the other gripping devices when one gripping device is blocked. The rated capacity limiter is advantageously a friction clutch, because this is both inexpensive and fulfills its purpose reliably.

In another advantageous refinement of the invention, the gear wheels have toothless regions. If the drive means are then moved, then there is rotation of some gripping units but not of others depending on whether a toothed region of a gear wheel is engaging in the next gear wheel or a toothless region of the gear wheel is passing by the next gear wheel. If the gear wheels of the gripping units are set so that there is rotation on one gripping unit but the rotation on the neighboring gripping unit occurs only at a later point in time, then the proposed function of the rotational device is again satisfied.

A method for removing full bobbins from spindles on a spinning machine and for placing empty tubes on the spindles with a doffer device of the type described above is also proposed here. The doffer device comprises at least one bar, a plurality of gripping devices and a rotational device. The gripping devices are each assigned to a spinning station of the spinning machine. Each gripping device has a base body and a rotary gripping unit. The gripping unit can be rotated between a gripping position, in which the bobbin can be gripped on the spindle, and a placement position, in which the tube can be placed on the spindle. This rotation is carried out by the rotational device. Each gripping unit has a tube gripper for gripping the empty tube and a bobbin gripper for gripping the full bobbin.

In a doffing operation, the tube gripper first grips the empty tube. Then the bobbin gripper grips the full bobbin from the spindle and removes it. In the remaining course, the gripping unit is rotated from the gripping position into the placement position, so that the tube gripper can place the empty tube on the spindle. According to the invention, the rotation from the gripping position to the placement position takes place in such a way that the two neighboring gripping units are rotated with a time lag relative to one another. Thus, the neighboring gripping units do not interfere with one another mutually in gripping even when the amount of available space is limited, and a rapid doffing operation is possible. According to the invention, the doffer device is driven by a toothed belt.

The rotation of the gripping units with a time lag from one to the other can be implemented well if the gripping units are assigned to two groups. Then two neighboring gripping units belong to different groups, i.e., the gripping units belong to one group and then another group in alternation. When the gripping units are rotating, the gripping units of one group are rotating at the same time but with a time lag relative to the gripping units of the other group. Due to this division of the gripping units into two groups, it is possible to ensure very easily but highly effectively that neighboring gripping units are rotated with a time lag relative to one another.

In an advantageous refinement of the invention, each gripping unit has two indicators, with which the position of the rotating device is visible through a base body. If a malfunction has occurred and the operator must retract or equip a gripping unit, then it is possible for the operator to ascertain the correct position from the outside. The two indicators must be set alternately when there are neighboring gripping units, so that the gripping units can be positioned and the missing gripping unit can be inserted correctly.

In an advantageous refinement of the invention, the gripping devices have positioning means. With the help of these positioning means, the gripping units are positioned accurately in the gripping position and/or the placement position with respect to the spindles. With a well-positioned gripping unit, the removal of the full bobbin and/or placement of the empty tube can be carried out accurately, which facilitates a smooth doffing operation.

Furthermore, a gripping device for a doffer device as described above is also proposed. The gripping device is designed for removing a full bobbin from a spindle on the spinning machine and for placement of an empty tube on the spindle. It has a base body and a gripping unit that can be rotated about an axis of rotation. The gripping unit can be rotated between a gripping position, in which the bobbin can be gripped on the spindle, and a placement position, in which the tube can be placed on the spindle. It comprises a bobbin gripper for gripping the full bobbin and a tube gripper for gripping an empty tube.

According to the invention, a position means, which accurately positions the gripping unit in the gripping position and/or the placement position with respect to the spindle, is provided. If the bobbin gripper and/or the tube gripper is accurately positioned, then the removal of the full bobbin and/or placement of the empty tube can be carried out accurately, which facilitates a smooth doffing operation.

In addition, it is advantageous if the gripping unit has a first gear wheel. The rotational movement can be controlled optimally by means of this gear wheel.

Furthermore, it is advantageous if the base body has at least one second gear wheel, wherein the additional gear wheel and/or one of the additional gear wheels meshes with the first gear wheel. Thus, the rotational movement can be carried out easily and effectively and can be transmitted. In particular, it is advantageous if at least one of the gear wheels has positioning means. In other words, the starting point and/or end point of the rotational movement can be determined very well and with a high precision by means of a positioning means on the gear wheel.

In an advantageous refinement of the invention, at least one of the gear wheels has a toothless region. When the toothless region passes by the next gear wheel, the next gear wheel is not rotated. With a skillful arrangement of the toothless region, it is thus possible to achieve the effect that the gripping units are rotated at one point in time but are not rotated at a later point in time or vice versa. This permits a special design of a doffer device, in which not all the gripping units are rotated at the same time.

Furthermore, it is advantageous if a rated capacity limiter is provided. Therefore, severe damage to the gripping device or to drive means driving the gripping device can be prevented for the case when the gripping device is blocked. Furthermore, with a rated capacity limiter, if one gripping device is blocked, it is possible to continue the doffing operation with the other gripping devices. The rated capacity limiter advantageously also has a friction clutch because it is not only inexpensive but also reliably fulfills its purpose.

In principle, the present invention is not limited to bobbin grippers or tube grippers but it is advantageous if the shape of the bobbin gripper and the tube gripper is adapted to the geometry of the bobbin and/or tube because these can then be gripped particularly well. Since the bobbin and the tube are normally cylindrical, this means that the bobbin gripper has a cylindrical bobbin receptacle and the tube gripper has a cylindrical tube receptacle. However, conical grippers are also conceivable within the scope of the invention.

The bobbin receptacle has a bobbin gripper axis and a bobbin gripper diameter, and the tube receptacle has a tube gripper axis and a tube gripper diameter. The bobbin gripper axis and the tube gripper axis are arranged at an angle to one another. This angle is advantageously between 4° and 10°, especially preferably 8°. If the angle is even smaller than the aforementioned angles, there would be imminent risk of contact of the bobbin and tube when they are gripped at the same time, or the distance between the bobbin gripper and tube gripper would have to be increased in order to prevent contact, which would require even more space. If the angles are larger than the aforementioned angles, there would be an increased risk of collision with parts of the machine or the neighboring grippers when the gripper unit is rotated, but the present invention attempts to prevent this. Accordingly, the aforementioned angle range has proven to be ideal.

Furthermore, it is favorable if the tube gripper diameter and the bobbin gripper diameter are the same and in particular if the tube gripper and the bobbin gripper are essentially identical. This not only eliminates production costs and facilitates the handling of replacement parts but also makes it possible to operate the gripper device in such a way that the bobbin gripper and the tube gripper exchange tasks after each doffing operation. In other words, the bobbin gripper becomes the tube gripper and vice versa. Finally, it is advantageous if the angle between the axis of rotation and the bobbin gripper axis is equal to the angle between the axis of rotation and the tube gripper axis. It is thus possible to achieve the effect that after rotation of the gripper unit, the positions of the bobbin gripper and the tube gripper are exactly interchanged, which then facilitates rapid placement of the empty tube.

BRIEF DESCRIPTION OF THE FIGURES

Additional advantages of the invention are described in the following embodiments, in which.

DETAILED DESCRIPTION

Figure 1A:
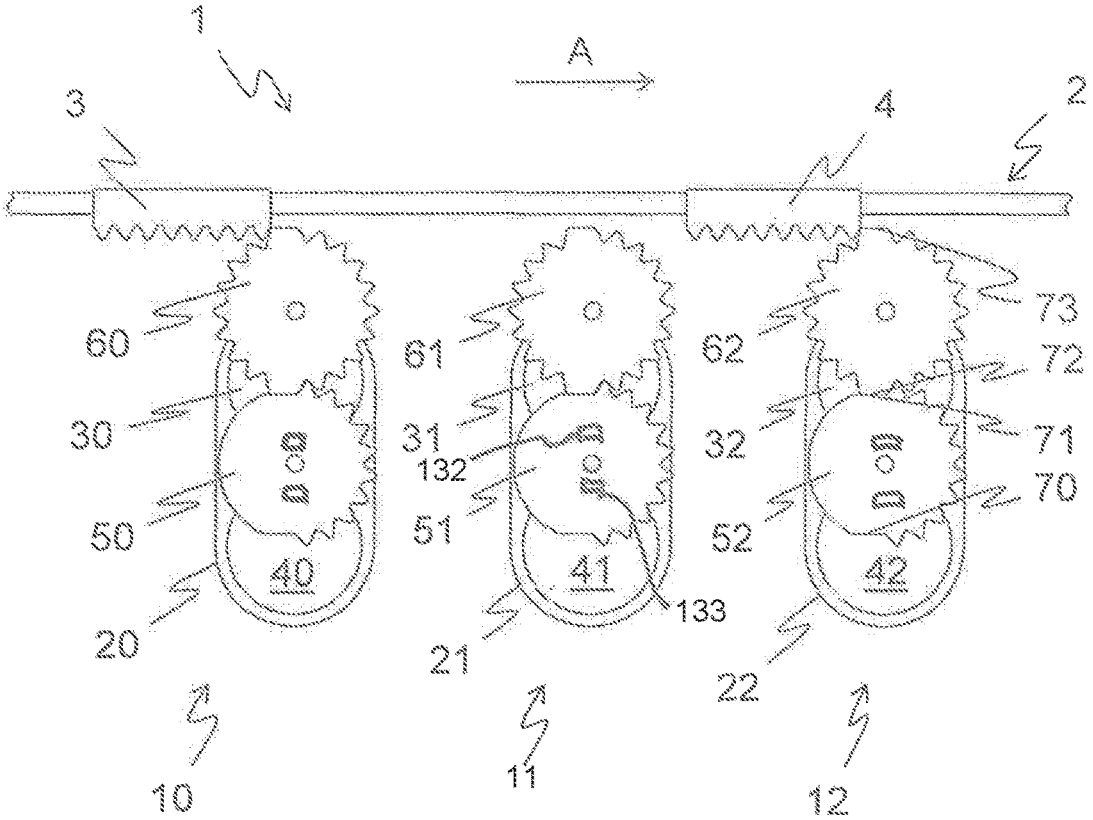
FIG. 1*a* shows a top view of a detail of a doffer device.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1*a* shows a top view of a detail of a doffer device 1 for a spinning machine, in which a portion of the drive rod 2 comprising two toothed regions 3, 4, and three gripping devices 10, 11, 12 are illustrated. The gripping devices 10, 11, 12 comprise gripping units 20, 21, 22 with tube grippers 30, 31, 32 and bobbin grippers 40, 41, 42. Furthermore, first gear wheels 50, 51, 52, which are fixedly connected to the gripping units 20, 21, 22, are also provided. The gripping devices 10, 11, 12 each also have additional gear wheels 60, 61, 62, which engage in the first gear wheels 50, 51, 52. Flattened locations 70, 71, 72, 73, which function as positioning means and accurately position the gripping units 20, 21, 22 in the gripping position and in the placement position, are provided on the first gear wheel and additional gear wheels 50, 51, 52, 60, 61, 62. For the sake of simplicity, only the flattened locations 70, 71, 72, 73 for the gripping device 12 have been labeled with reference numerals.

For a doffing operating, the gripping devices 10, 11, 12 are now moved from a bar (not shown here) in such a way that the tube grippers 30, 31, 32 can grip empty tubes. Then the gripping devices 10, 11, 12 are moved over spindles on the spinning machine, so that the bobbin grippers 40, 41, 42 are able to grip full bobbins from the spindles. The full bobbins are then removed from the spindles. Next, the drive rod 2 is moved in the direction of the arrow A. In doing so, the toothed regions 3, 4 first engage in the gear wheels 60, 62 of the gripping devices 10, 12, so that the gripping units 20, 22 are rotated. The rotation of the gripping units 20, 22 is readily possible because the gripping unit 21 is not rotated, and consequently, they do not interfere with one another mutually.

Figure 1B:
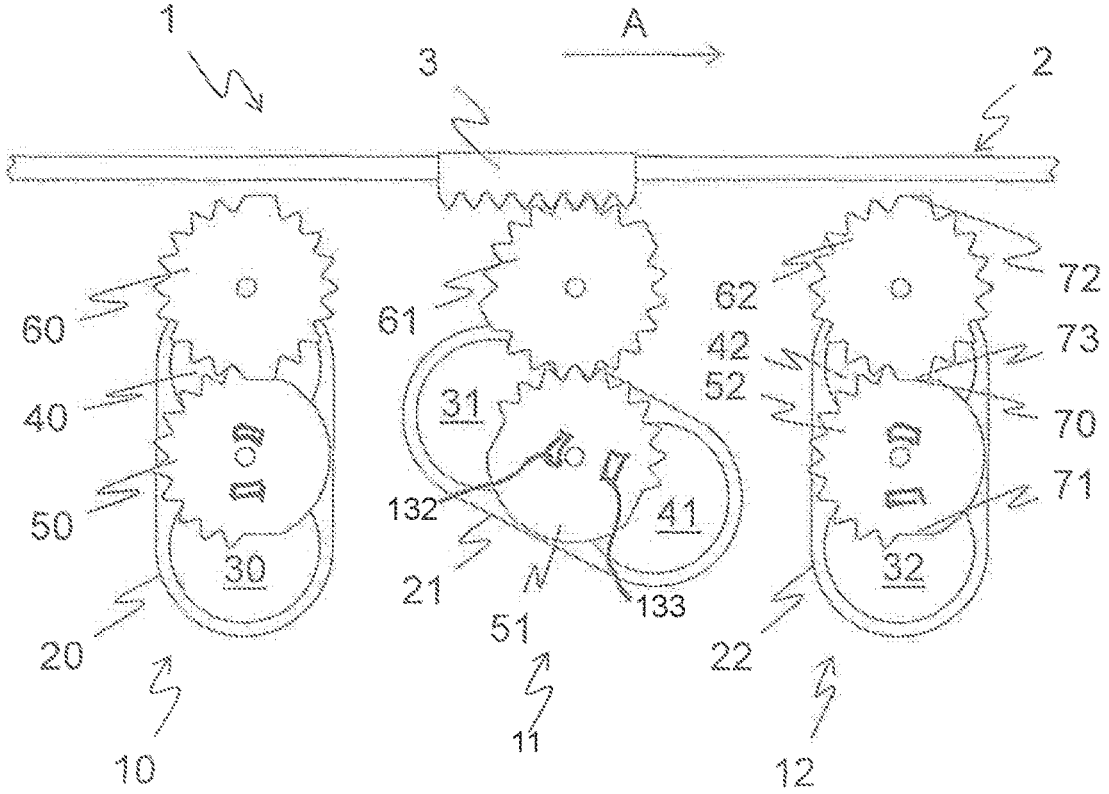
FIG. 1*b* shows a top view of the detail of the doffer device from FIG. 1*a* at a later point in time.

FIG. 1*b* shows a detail of the doffer device 1 at a later point in time. The gripping units 20, 22 were already rotated into the placement position here, wherein the tube grippers 30, 32 and the bobbin grippers 40, 42 have already exchanged placed in comparison with the gripping position. The toothed region 3 now engages with the gear wheel 61, and the gripping unit 21 is rotated further in the direction of the arrow A by the movement of the drive rod 2. Due to the fact that the gripping units 20, 22 are not rotated simultaneously with the gripping unit 21, they do not interfere with the gripping unit 21 in rotation.

Figure 2A:
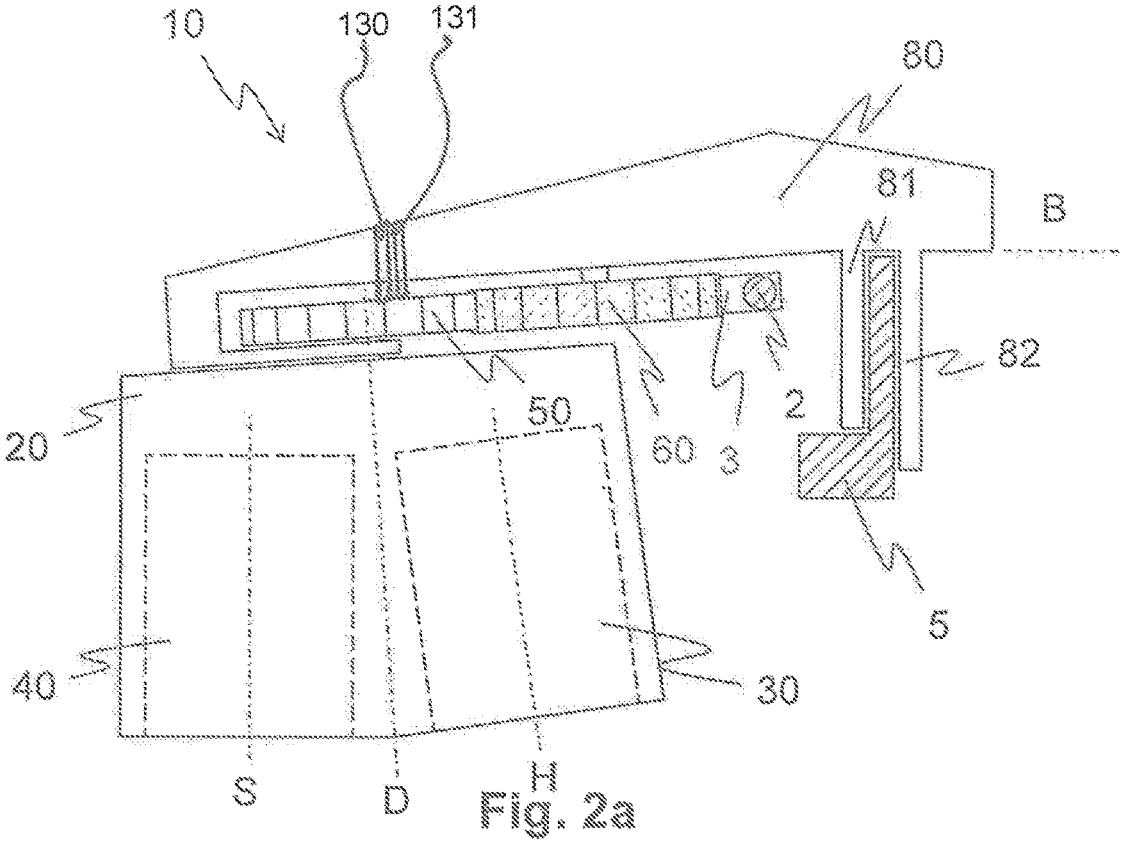
FIG. 2*a* shows a side view of a gripper device.

FIG. 2*a* shows a side view of the gripping device 10. This also shows the drive rod 2, the toothed region 3 and the bar 5 of the doffer device. A base body 80 of the gripping device 10 has two legs 81, 82, which affix it on the bar 5 in the fastening plane B. The first gear wheel 50, as described above, is connected to the gripping unit 20 while the additional gear wheel 60 which engages with the first gear wheel 50 and the toothed region 3, is connected to the base body 80. If the drive train 2 is moved with the toothed region, then the additional gear wheel 60 and the first gear wheel 50, and thus also the gripping unit 20, rotate. The gripping unit 20 rotates about an axis of rotation D. This shows a tube gripper axis H and a bobbin gripper axis S, wherein the angle between the tube gripper axis H and the axis of rotation D and the angle between the bobbin gripper axis S and the axis of rotation D are each 4°. The angle between the tube gripper axis H and the bobbin gripper axis S is thus 8°. Furthermore, the axis of rotation D about the angle between the bobbin gripper axis S and the axis of rotation D is thus 4° is inclined relative to a vertical line to the fastening plane B, so that the bobbin gripper axis S is vertical in the gripping position and is thus parallel to an axis of the spindle. After rotation of the gripper unit 20 into the placement position, the tube gripper axis H then runs vertically and therefore parallel to the axis of the spindle.

Figure 2B:
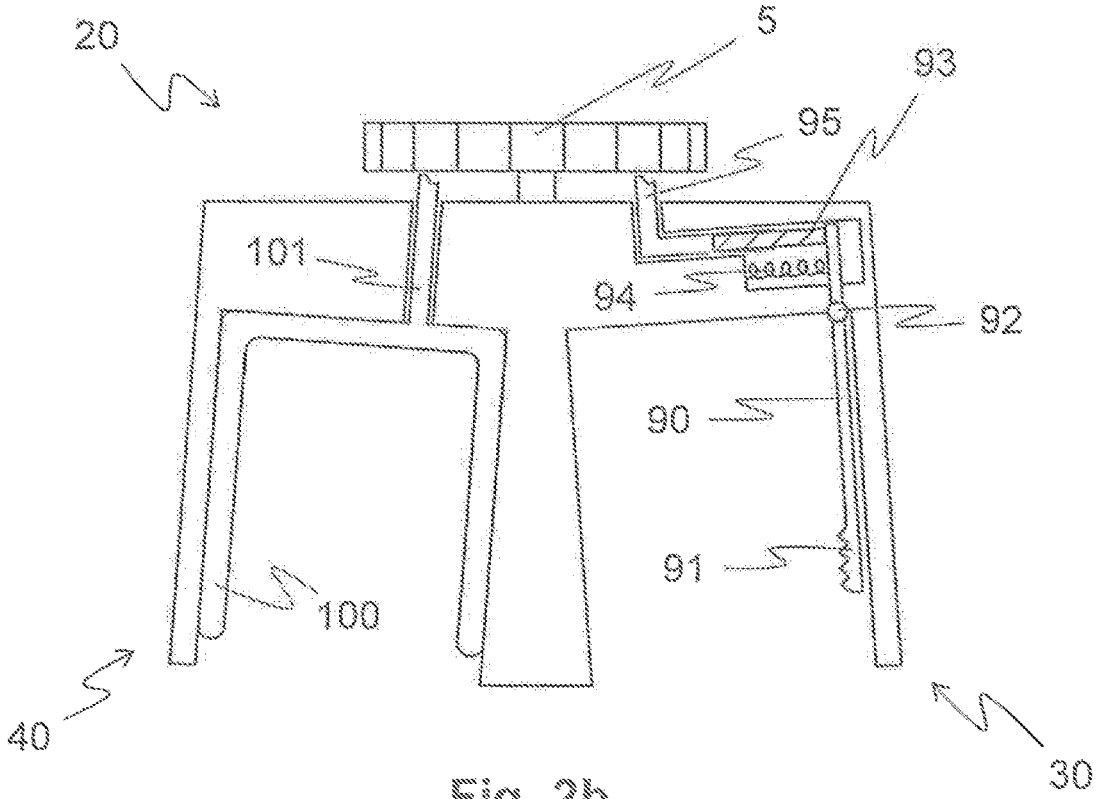
FIG. 2*b* shows a schematic side view of a gripping device.

The gripping unit 20 with the tube gripper 30 and the bobbin gripper 40 are illustrated in detail in FIG. 2*b*. In this embodiment the tube gripper 30 is equipped with a clamping element 90, and the bobbin gripper 40 is equipped with a membrane 100. However, other combinations of the grippers and other types of grippers are also possible for the present invention.

The clamping element 90 has a gripping clamping region 91 and is mounted so it can rotate about an axis 92. A bolt 93 and a restoring spring 94 act on the clamping element 90 on the side of the axis 92 opposite the clamping region 91. The bolt 93 here is connected to a pneumatic line 95. If a tube is to be gripped, the bolt 93 is forced onto the clamp 90 via the pneumatic line 95, so that the clamping region 90 secures the tube. If the tube is then to be released again, the pressure in the pneumatic line 95 is reduced and the restoring spring 94 retracts the clamping element 90 and releases the tube.

In the case of the bobbin gripper 40, the membrane 100 is connected to a pneumatic line 101. If a bobbin is to be gripped, the membrane 100 is pumped up via the pneumatic line 101 and surrounds the bobbin. If the bobbin is then to be released again, the air pressure in the pneumatic line 101 and therefore in the membrane 100 is reduced and the bobbin is released again.

In another embodiment (not shown), the tube gripper and bobbin gripper are operated pneumatically. The tube gripper and the bobbin gripper may be conical in design (not shown). The conical design has the advantage of a better hold of the bobbin and tube, in particular when both are being operated pneumatically because the membrane conforms better to the tube and the bobbin.

Figure 3A:
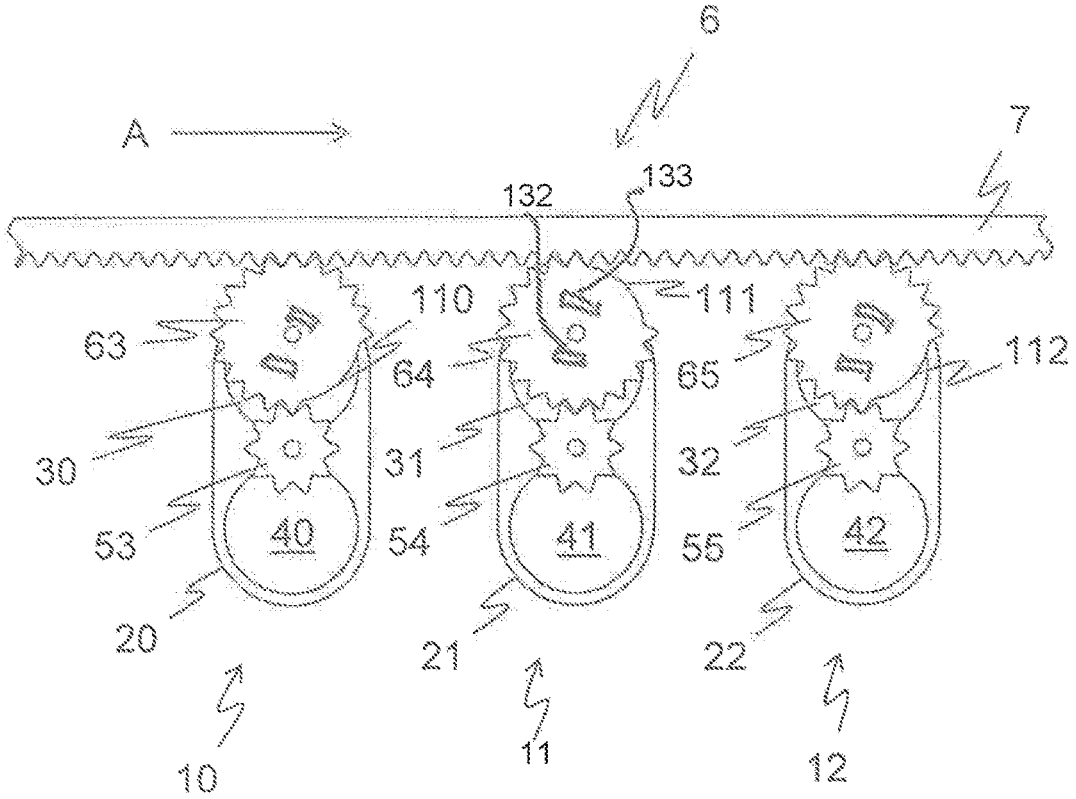
FIG. 3*a* shows a top view of a detail of another doffer device.

FIG. 3*a* shows a top view of a detail of another embodiment of a doffer device 6 according to the invention. In the following description, the same reference numerals are used for features which are identical in their design and/or mechanism of action and/or at least comparable in comparison with the first embodiment illustrated in FIGS. 1*a* and 1*b*. If these are not described in detail again, their design and/or mechanism of action correspond to the design and mechanism of action of the features already described above.

In this embodiment, a continuously toothed drive rod 7 is provided. It engages in additional gear wheels 63, 64, 65 connected to the base bodies of the gripping devices 10, 11, 12. These additional gear wheels 63, 64, 65 in turn engage in first gear wheels 53, 54, 55 connected to the gripping units 20, 21, 22. To achieve the time-offset rotation of neighboring gripping units 20, 21, 22 according to the invention, the additional gear wheels 63, 64, 65 are not toothed continuously but instead have toothless regions 110, 111, 112. The toothless region 111 is positioned differently in comparison with the toothed regions 110, 112.

Figure 3B:
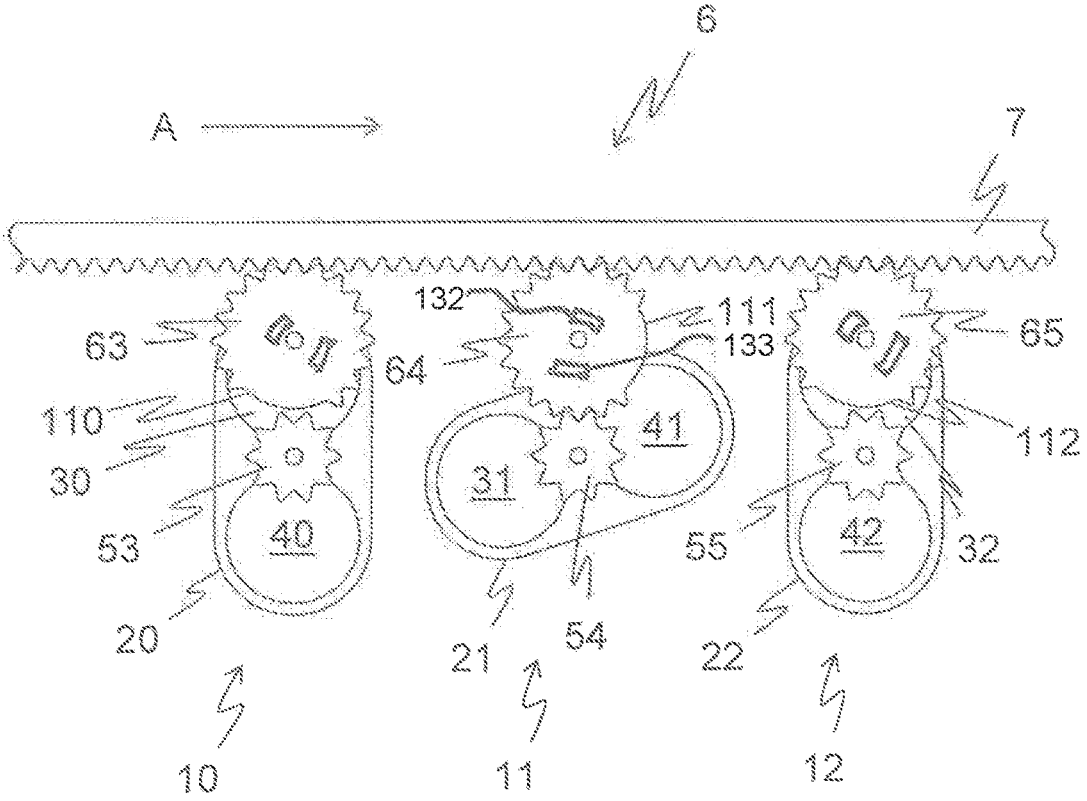
FIG. 3*b* shows a top view of the detail of the doffer device from FIG. 3*a* at a later point in time.

If the drive rod 7 is now moved in the direction of the arrow A, then the toothless regions 110, 112 first pass by the first gear wheels 53, 55 on//in the gripping devices 10, 12 so that the gripping units 20, 22 are not rotated. With the gripping device 11 however, the additional gear wheel 64 engages in the first gear wheel 54 and rotates the gripping unit 21. FIG. 3*b* shows the doffer device during this rotation. Since the gripping units 20, 22 are not rotating, the gripping unit 21 has enough room to rotate.

The toothless region 111 of the second gear wheel 64 is designed so that it arrives at the first gear wheel 54 when the gripping unit 21 has finished rotating. Then the additional gear wheels 63, 65 also begin to engage with the first gear wheels 53, 55 and rotate the gripping devices 20, 22 while the gripping device 21 is not rotating.

Figure 4A:
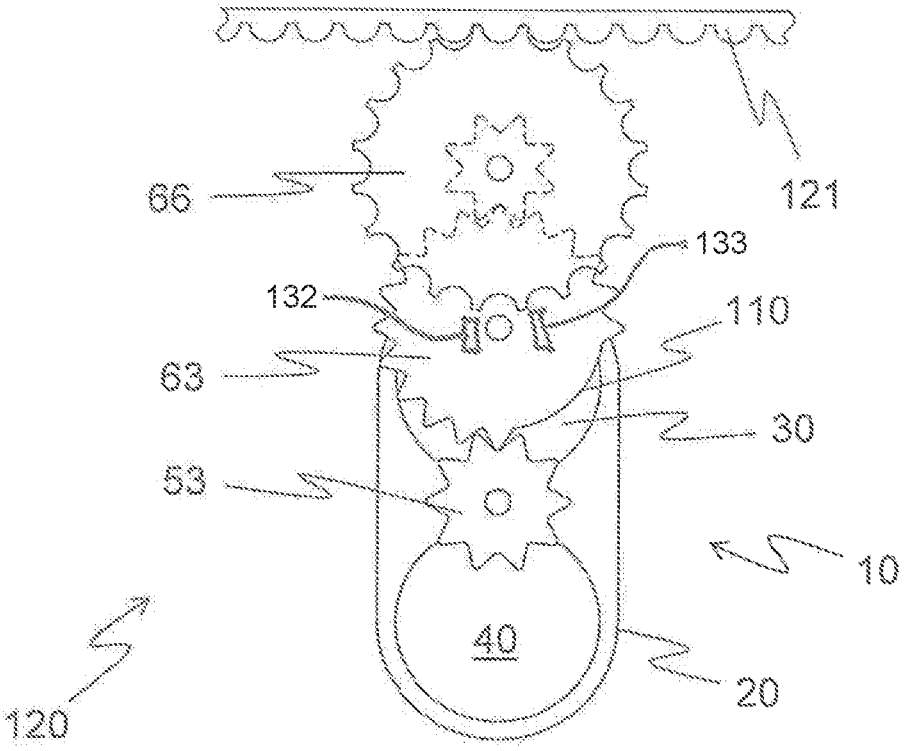
FIG. 4*a* shows a top view of a detail of another doffer device.

FIG. 4*a* shows a top view of a detail of another embodiment of a doffer device 120 according to the invention. In the following description, the same references numerals are used for features which are identical and/or at least comparable in their design and/or mechanism of action in comparison with the first and/or second embodiments illustrates in FIGS. 1*a* and 1*b* and/or 3*a* and 3*b*. If these are not explained again in detail, their embodiment and/or mechanism of action correspond to the embodiment and mechanism of action of the features already described above.

In comparison with the embodiment illustrated in FIG. 3*a*, a drive belt 121 is used here instead of the drive rod. Furthermore, another gear wheel 66 is provided, which meshes with the additional gear wheel 63 and the drive belt 121. Due to the gear ratio of the additional gear wheel 66, the tensile force to be applied by the drive belt 121//tractive force is reduced.

Figure 4B:
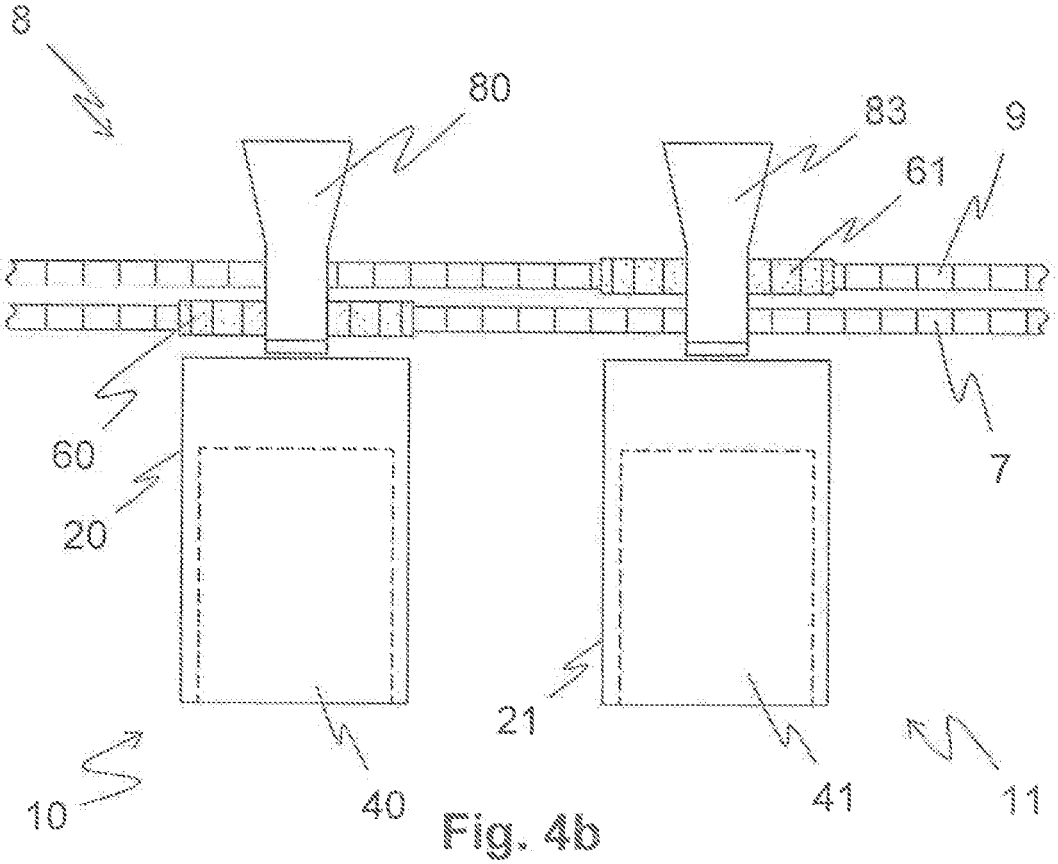
FIG. 4*b* shows a frontal view of a detail of another doffer device.

FIG. 4*b* shows a frontal view of a detail of another embodiment of a doffer device 8 according to the invention. In the following description, the same reference numerals are used for features which are identical in their embodiment and/or mechanism of action and/or at least comparable in comparison with the first, second and/or third embodiments illustrated in FIGS. 1*a* and 1*b*, 3*a* and 3*b* and/or 4*a*. If these are not explained in detail again, their embodiment and/or mechanism of action correspond to the embodiment and mechanism of action of the features already described above.

This embodiment has two continuously toothed drive rods 7, 9. Furthermore, the second gear wheels 60, 61 are arranged on the base bodies 80, 83 of the gripping devices 10, 11 so that the second gear wheel 60 engages with the drive rod 7, and the second gear wheel 61 engages with the drive rod 9. For the sake of simplicity, this does not show the first gear wheels which engage with the respective second gear wheels 60, 61. In a doffing operation, the drive rod 7 is then moved first so that the gripping unit 20 will rotate. Since the gripping unit 21 does not rotate at the same time, the gripping unit 20 has enough space to rotate. As soon as the gripping unit 20 has finished rotating, the drive rod 7 is stopped and the drive rod 9 is moved. Then the gripping unit 21 rotates.

Figure 5:
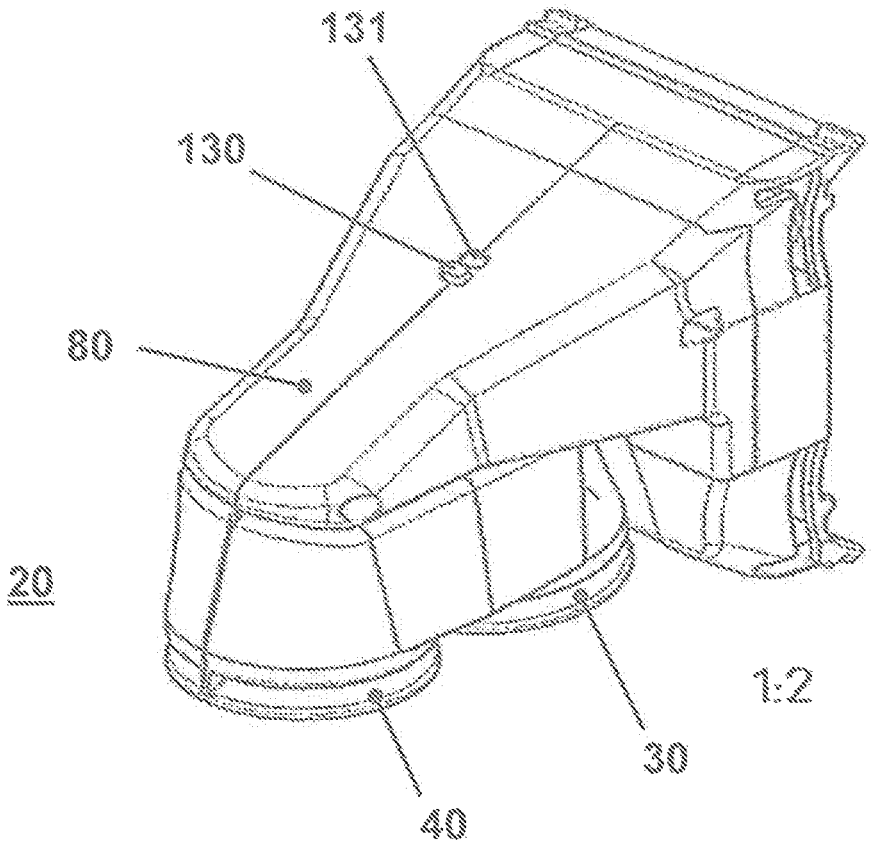
FIG. 5 shows a view of the base body with two indicators.

FIG. 5 shows a base body 80 with two indicators 130, 131 according to the invention. The indicators 130, 131 are mounted on the top side and indicate to an operator the location of the gripping unit 20. If a malfunction has occurred and the operator must reengage or equip a gripping unit, he can recognize the correct position from the outside. The two indicators 130, 131 must be set in alternation on neighboring gripping units 20, so that the gripping units can be positioned correctly and the missing gripping unit can be used correctly. In the embodiment mentioned, elevated locations 132, 133 which cooperate with the indicators 130, 131 are each arranged with an offset at a certain location on the gear wheel 50, 51, 53 (FIGS. 1*a, b*), 63, 64, 65 (FIGS. 3*a, b*).

The present invention is not limited to the embodiments described and illustrated here. Modifications within the scope of the patent claims are also possible as is a combination of features, although these are illustrated and described in various embodiments.

LIST OF REFERENCE NUMERALS

1 Doffer device
2 Drive rod
3, 4 Toothed region
5 Bar
6 Doffer device
7 Continuously toothed drive rod
8 Doffer device
9 Continuously toothed drive rod
10-12 Gripping device
20-22 Gripping unit
30-32 Tube gripper
40-42 Bobbin gripper
50-55 First gear wheel
60-65 Additional gear wheel
70-73 Flattened location
80 Base body
81, 82 Leg
83 Base body
90, 91 Clamping element
92 Axis
93 Bolt
94 Restoring spring
100 Membrane
101 Pneumatic line
110, 111, 112 Toothless region
120 Doffer device
121 Drive belt
130 Indicator
131 Indicator
132 Elevated location
133 Elevated location
A Direction of movement
B Fastening plane
D Axis of rotation
H Tube gripper axis
S Bobbin gripper axis

The invention claimed is:

1. A doffer device for a spinning machine having a plurality of spinning stations, the doffer device configured to remove full bobbins from spindles on the spinning machine and place empty tubes on the spindles, the doffer device comprising:

a plurality of gripping devices, each gripping device assigned to one of the spinning stations and comprising a rotatable gripping unit;

each gripping unit comprising a bobbin gripper that grips the full bobbin and a tube gripper that grips the empty tube;

each gripping unit rotatable between a gripping position in which the full bobbin can be gripped on the spindle and a placement position in which the empty tube can be placed on the spindle;

at each spinning station, a rotating device configured with the gripping unit to rotate the gripping unit about an axis of rotation such that the gripping unit at neighboring spinning stations are rotated with a time lag relative to one another;

wherein the rotating device is driven by a toothed belt; and wherein the rotating device is configured with a capacity limiter device.

2. The doffer device according to claim 1, wherein the bobbin grippers and the tube grippers are cylindrical or conical and pneumatically operated.

3. The doffer device according to claim 1, wherein each gripping device comprises a base body, each gripping unit further comprising two indicators disposed so that a position of the rotating device is visible through the base body.

4. The doffer device according to claim 1, wherein the rotating device comprises gear wheels connected to the gripping devices.

5. The doffer device according to claim 1, wherein each gripping device comprises means for positioning the gripping device between the gripping position and the placement position upon being rotated by the rotating device.

6. A doffer device for a spinning machine having a plurality of spinning stations, the doffer device configured to remove full bobbins from spindles on the spinning machine and place empty tubes on the spindles, the doffer device comprising:

a plurality of gripping devices, each gripping device assigned to one of the spinning stations and comprising a rotatable gripping unit;

each gripping unit comprising a bobbin gripper that grips the full bobbin and a tube gripper that grips the empty tube;

each gripping unit rotatable between a gripping position in which the full bobbin can be gripped on the spindle and a placement position in which the empty tube can be placed on the spindle;

at each spinning station, a rotating device configured with the gripping unit to rotate the gripping unit about an axis of rotation such that the gripping unit at neighboring spinning stations are rotated with a time lag relative to one another;

wherein the rotating device is driven by a toothed belt; and wherein each bobbin gripper comprises a bobbin gripper axis, and each tube gripper comprises a tube gripper axis, wherein the bobbin gripper axis and the tube gripper axis are at an angle to one another of between 4° and 10°.

7. The doffer device according to claim 6, wherein an angle between the axis of rotation of the rotating device and the bobbin gripper axis is equal to an angle between the axis of rotation of the rotating device and the tube gripper axis.

8. The doffer device according to claim 7, wherein the axis of rotation of the rotating device is inclined relative to vertical by the angle between the bobbin gripper axis and the axis of rotation of the rotating device so that in the gripping position, the bobbin gripper axis is vertical and parallel to an axis of the spindle.

9. The doffer device according to claim 6, wherein the bobbin grippers and the tube grippers are cylindrical or conical and pneumatically operated.

10. The doffer device according to claim 6, wherein each gripping device comprises a base body, each gripping unit further comprising two indicators disposed so that a position of the rotating device is visible through the base body.

11. The doffer device according to claim 6, wherein the rotating device comprises gear wheels connected to the gripping devices.

12. The doffer device according to claim 6, wherein each gripping device comprises means for positioning the gripping device between the gripping position and the placement position upon being rotated by the rotating device.

* * * * *